US009441837B2

(12) United States Patent
Pasqualotto et al.

(10) Patent No.: US 9,441,837 B2
(45) Date of Patent: Sep. 13, 2016

(54) PREMIX BURNER OF THE MULTI-CONE TYPE FOR A GAS TURBINE

(71) Applicant: ALSTOM Technology Ltd, Baden (CH)

(72) Inventors: Ennio Pasqualotto, Winterthur (CH); Franklin Marie Genin, Baden (CH); Jaan Hellat, Baden-Rütihof (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 485 days.

(21) Appl. No.: 13/937,502

(22) Filed: Jul. 9, 2013

(65) Prior Publication Data

US 2014/0013759 A1 Jan. 16, 2014

(30) Foreign Application Priority Data

Jul. 10, 2012 (EP) ..... 12175639

(51) Int. Cl.
*F23R 3/28* (2006.01)
*F23C 7/00* (2006.01)

(52) U.S. Cl.
CPC ..... *F23R 3/286* (2013.01); *F23C 7/002* (2013.01); *F23C 2900/07002* (2013.01)

(58) Field of Classification Search
CPC ..... F23C 7/002; F23C 2900/07002; F23R 3/286
See application file for complete search history.

(56) References Cited

U.S. PATENT DOCUMENTS

| | | | | |
|---|---|---|---|---|
| 5,489,203 | A | 2/1996 | Döbbeling et al. | |
| 5,735,687 | A * | 4/1998 | Knopfel | F23C 7/002 431/115 |
| 6,027,331 | A * | 2/2000 | Dobbeling | F23C 7/002 431/182 |
| 6,186,775 | B1 * | 2/2001 | Jansohn | F23C 7/002 431/258 |
| 6,210,152 | B1 * | 4/2001 | Haffner | F23C 7/002 431/12 |
| 6,702,574 | B1 | 3/2004 | Döbbeling | |
| 2007/0128564 | A1 * | 6/2007 | Paschereit | F23C 7/002 431/350 |
| 2007/0202453 | A1 * | 8/2007 | Knoepfel | F23C 7/002 431/354 |
| 2007/0207431 | A1 * | 9/2007 | Oomens | F23C 7/002 431/354 |

FOREIGN PATENT DOCUMENTS

| | | | |
|---|---|---|---|
| CN | 1163372 | A | 10/1997 |
| CN | 1942710 | A | 4/2007 |
| CN | 101044355 | A | 9/2007 |
| DE | 195 45 310 | | 6/1997 |
| EP | 0711953 | A2 | 5/1996 |
| EP | 0 851 172 | | 7/1996 |
| EP | 2 423 597 | | 2/2012 |
| JP | 04-320711 | | 11/1992 |
| JP | 08-042357 | | 2/1996 |
| JP | 08-226649 | | 9/1996 |
| JP | 09-014635 | | 1/1997 |
| JP | 11-223306 | | 8/1999 |
| JP | 2002-130676 | | 5/2002 |
| JP | 2012-037234 | | 2/2012 |
| RU | 1835031 | A3 | 8/1993 |
| RU | 2002165 | C1 | 10/1993 |

* cited by examiner

*Primary Examiner* — Carlos A Rivera
(74) *Attorney, Agent, or Firm* — Buchanan Ingersoll & Rooney PC

(57) ABSTRACT

The invention relates to a premix burner of the multi-cone type for a gas turbine that includes a plurality of shells which are arranged around a central burner axis and are parts of a virtual, axially extending common cone, which opens in a downstream direction, whereby said parts are displaced perpendicular to said burner axis such that a tangential slot is defined between each pair of adjacent shells. The flame front of such a burner is stabilized by providing a virtual common cone with a cone angle, which varies in axial direction.

19 Claims, 4 Drawing Sheets

PREMIX BURNER OF THE MULTI-CONE TYPE FOR A GAS TURBINE

CROSS-REFERENCE TO RELATED APPLICATIONS

This application claims priority to European Application 12175639.9 filed Jul. 10, 2012, the contents of which are hereby incorporated in its entirety.

TECHNICAL FIELD

The present invention relates to the technology of gas turbines. It refers to a premix burner of the multi-cone type for a gas turbine according to the preamble of claim 1.

BACKGROUND

In the past more than 20 years burners with short but effective premixing zones (so-called EV burners: environmental friendly V-shaped burners) have been implemented in several gas turbines of the applicant, with very low NOx levels. In addition to this, three variants of premix technologies have been successfully developed and deployed into those gas turbine engines: the sequential EV burners—a technology that allows premixing of natural gas and oil into a hot exhaust stream to reheat the exhaust gases of a first high pressure turbine; the MBtu EV burners that are used to burn syngas in a premix flame with low NOx emissions; and the advanced EV burners (AEV) that are capable to pre-vaporize and premix liquid fuel prior to combustion and burn it with very low NOx emissions without water injection.

Document EP 0 851 172 A2 discloses an exemplary EV burner of the double-cone type, for operating a combustion chamber with a liquid and/or gaseous fuel, whereby the combustion air required for this purpose is directed through tangential air-inlet ducts into an interior space of the burner. This directing of the flow results in a swirl flow in the interior space, which swirl flow induces a backflow zone at the outlet of the burner. In order to stabilize the flame front forming there, at least one zone is provided at each sectional body forming the burner, within which zone inlet openings are provided for the injection of supplementary air into the swirl flow. Due to this injection, a film forms at the inner wall of the sectional bodies, which film prevents the flame from being able to flashback along the inner wall of the sectional bodies into the interior space of the burner.

Document EP 2 423 597 A2 shows another exemplary EV burner in the form of a double-cone burner, which has two partial cone shells which are arranged nested one inside the other, forming air inlet ducts between them, through which combustion air from the outside flows into a conical inner space of the premix burner. Linear rows of holes of injection openings, which extend transversely to the flow direction of the combustion air, are arranged on the outer walls of the air inlet ducts and through which a gaseous fuel is injected into the combustion air which flows past transversely to them.

Document DE 195 45 310 A1 disclose a further premixing burner consisting of a hollow cone with an outer and inner cone casing. At least two inlet ducts run at a tangent to the inner cone casing and are positioned along a straight cone casing line. The part cone axes of the part shells formed lie on the same cone axis. The pre-mixing burner is divided into at least two, for example four, parts containing the inlet ducts so as to swirl the combustion air. A fuel nozzle is positioned at the cone tip for injecting liquid fuel.

The main design parameters for the current EV and AEV burners with a straight cone are the exit diameter, the slot width and the cone angle. These parameters are chosen such, that for a given throughflow capacity and pressure loss the vortex breakdown occurs near to the burner exit. The constraint is that the swirl strength is increasing linearly along the axis until it reaches the critical swirl strength for vortex breakdown near to the burner axis. This means that with these parameters the burner length and burner envelope is preset.

SUMMARY

It is an object of the present invention to provide a premix burner of the multi-cone type, which avoids the drawbacks of the known premix burners and has a high stability of the central recirculation bubble and therefore reduced axial oscillations of the flame front.

It is another object of the present invention to provide a premix burner, which provides the possibility to achieve a stable combustion without a bluff body such as a long lance.

These and other objects are obtained by a premix burner according to claim 1.

The premix burner according to the invention comprises a plurality of shells, which are arranged around a central burner axis and are parts of a virtual, axially extending common cone, which opens in a downstream direction, whereby said parts are displaced perpendicular to said burner axis such that a tangential slot is defined between each pair of adjacent shells.

It is characterized in that said virtual common cone has a cone angle, which varies in axial direction.

According to an embodiment of the invention the cone angle of the virtual common cone increases in the downstream direction.

Specifically, the variation of the cone angle of the virtual common cone is generated by twisting said common cone around the central burner axis.

More specifically, the surface area of the twisted common cone is generated by rotating a meridian around the central burner axis, one end of which is rotated around the central burner axis relative to the other end by a predetermined twist angle, and that the shells are generated by cutting said virtual common cone along respective meridians.

Especially, the twist angle is equal to or larger than 30°.

Specifically, the twist angle is equal to or larger than 60°.

According to another embodiment of the invention the common cone is subdivided into four equal parts or shells.

According to a further embodiment of the invention each of the shells is equipped with a premix gas channel extending along an axially oriented edge of the respective shell such that a gas can be injected from said premix gas channel through gas injection holes into a stream of air entering the interior of the arrangement of shells through the adjacent slot.

Specifically, said premix gas channels each have a cylindrical shape.

BRIEF DESCRIPTION OF THE DRAWINGS

The present invention is now to be explained more closely by means of different embodiments and with reference to the attached drawings.

DETAILED DESCRIPTION

Figure 5:
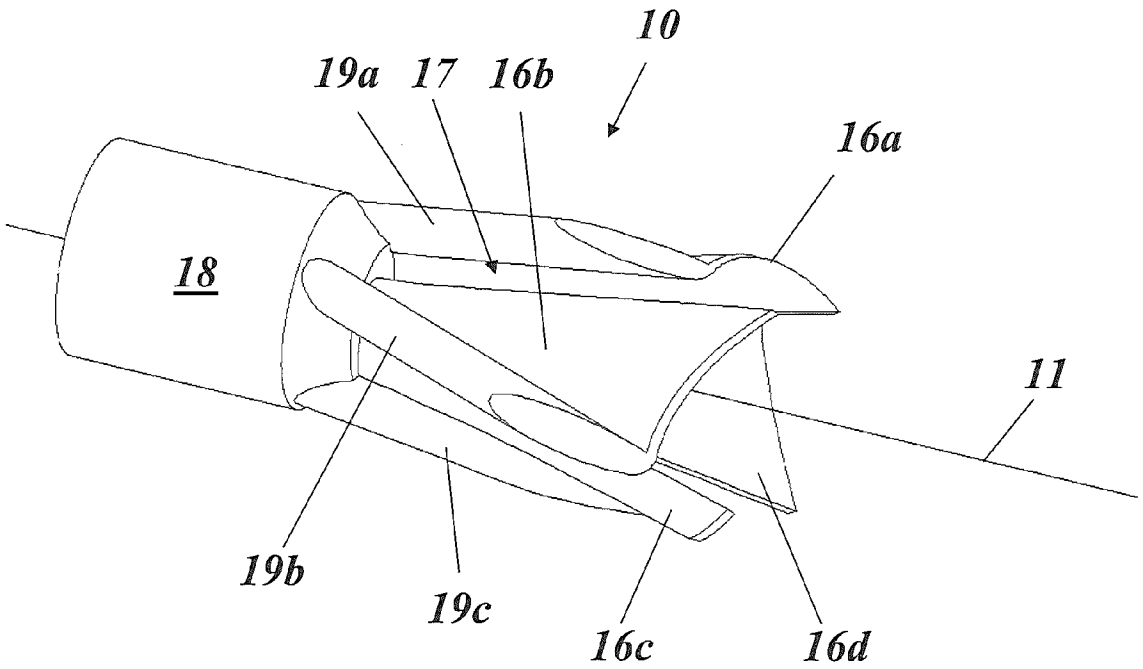
FIG. 5 shows the burner configuration of FIG. 4 with premix gas channels arranged at each inter-shell slot.

FIG. 5 shows a configuration of a premix burner 10 according to an embodiment of the invention, comprising a swirler arrangement extending along a central burner axis 11, with a burner lance 18, followed in downstream direction by four shells 16*a-d*, which have a conical shape, are displaced perpendicular to the axis 11 and are arranged in a 90° rotational symmetry with respect to axis 11. Between each pair of adjacent shells a slot 17 is provided, through which air can enter the interior of the shell arrangement. A premix gas channel 19*a-c* running along a longitudinal edge of each shell ejects a gaseous fuel through a series of holes (not shown) into the air stream entering the slots 17, thereby initiating a premixing of air and fuel.

In order to improve the incidence angle of the air flow due to a highly axially approach flow, the present invention utilizes straight premix gas channels 19*a-c*, which are not defined in the burner meridian plane, but which are inclined to the burner meridian plane.

By inclining the straight gas channels 19*a-d*, all surface lines of the EV type burner shells are twisted around, deviating from the original conical shape towards a bell type shape.

Figure 1:
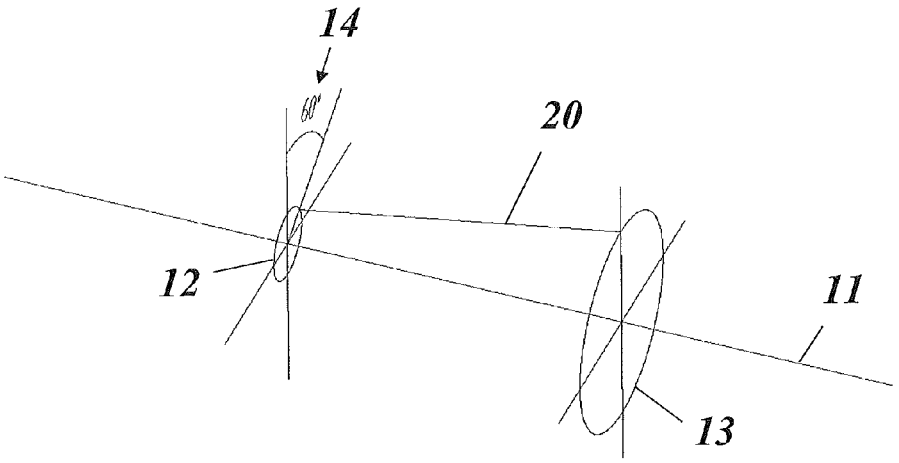
FIG. 1 shows the basic geometrical elements for generating a virtual cone for a premix burner according to an embodiment of the invention with a twist angle of 60°.

With reference to FIG. 1-4, this twisting may be explained as follows: To generate the shape of the shells 16*a-d*, one starts with a geometry as shown in FIG. 1, where a burner head 12 (upstream end of the burner) is represented by a first circle having a small diameter and being oriented perpendicular to and coaxial with a burner axis 11. A burner exit 13 (downstream end of the burner) is represented by a second circle having a larger diameter and being oriented perpendicular to and coaxial with a burner axis 11. An exemplary meridian 20 is now twisted with its upstream end around the burner axis 11 by a twist angle 14 relative to the downstream end. The twist angle 14 in this example is 60°.

Figure 2:
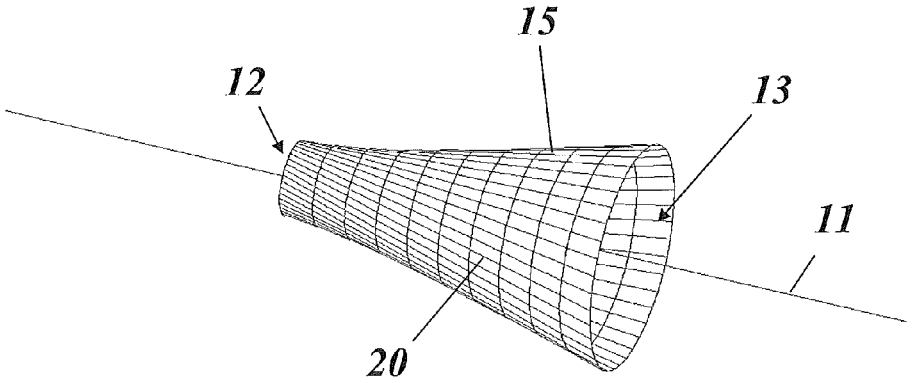
FIG. 2 shows the bell-shaped virtual cone generated by the elements of FIG. 1.

Now, the twisted meridian 20 is rotated around the burner axis 11 to generate a virtual cone 15, which is twisted and thus bell-shaped (FIG. 2).

Figure 3:
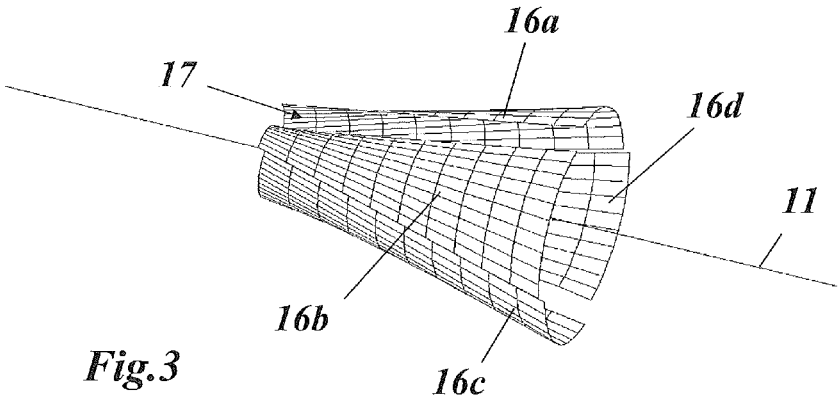
FIG. 3 shows the breakdown of the virtual cone of FIG. 2 into four separate shells, which are then, displaced perpendicular to the burner axis.

The virtual cone 15 of FIG. 2 is then subdivided into four separate shells 16*a-d*, which are each displaced perpendicular to the burner axis to open four slots 17 distributed around the burner axis 11 in steps of 90° (FIG. 3).

Figure 4:
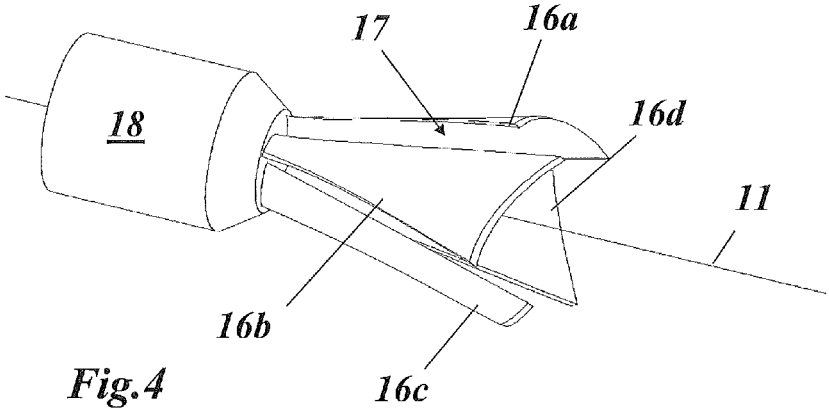
FIG. 4 shows the actual combination of the real shells according to FIG. 3 with a respective burner lance.

FIG. 4 shows again the four shells 16*a-d*, now having a certain thickness and being cut at a certain radius from the axis 11. Also the head of the burner and the last part of the fuel lance 18 are shown in FIG. 4.

FIG. 5 shows the burner swirler consisting of the four shells 16*a-d* with attached four cylindrical premix gas channels 19*a-c*. Both, the shells 16*a-d* and the gas channels 19*a-c* are cut at a certain radius from the burner axis 11. The gas channels 19*a-c* are oriented along the inclined meridian lines and contain many gas injection holes along the pipes to achieve a good premixing of the gas and the air entering through the longitudinal slots 17.

The bell shape of the burner shells 16*a-d* has a smaller cone angle in the upstream part of the burner than on the downstream part of the burner. This is an important innovative feature, since it allows varying the burner swirl number along the burner axis 11: The smaller cone angle leads to a lower swirl number in the upstream burner part, whereas the larger cone angle downstream yields a higher swirl number there.

This has the following consequences:

The main design parameters for the current EV and AEV burners with a straight cone are the exit diameter, the slot width and the cone angle. These parameters are chosen such, that for a given throughflow capacity and pressure loss the vortex breakdown occurs near to the burner exit. The constraint is that the swirl strength is increasing linearly along the axis until it reaches the critical swirl strength for vortex breakdown near to the burner axis. This means that with these parameters the burner length and burner envelope is preset.

Contrasting to this the actual invention has a steadily increasing gradient of the swirl strength along the axis. This means that the critical swirl strength for the vortex breakdown is achieved with a stronger swirl strength gradient, as compared to the EV and AEV burners with a straight cone, which means a better fixation of the axial vortex breakdown position due to a stronger aerodynamic holding force. It is also possible to achieve with this design a shorter burner layout for a given throughflow capacity and pressure loss as compared to the current design with a straight cone.

Furthermore, the possibility to achieve a stable combustion without a bluff body such as a long lance, allows to inject dry oil very upstream at the burner head and therefore to have sufficient time for fuel oil to evaporate along the burner axis until it enters the central recirculation zone where it will be ignited.

Figure 6:
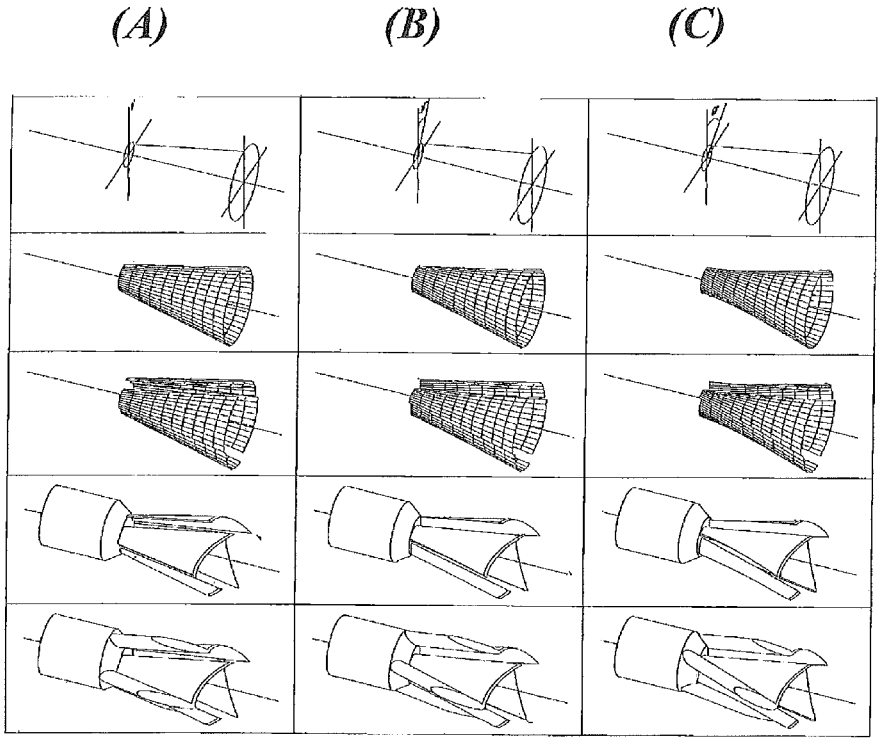
FIG. 6 shows in form of a comparative table the burner configuration for three different twist angles, i.e. 0° (A), 30° (B) and 60° (C).

The example of FIG. 1-5 shows a shell configuration with a twist angle of the virtual cone of 60°. However, other twist angles may be used. FIG. 6 shows in form of a comparative table the burner configuration and its derivation for three different twist angles, i.e. 0° (A), 30° (B) and 60° (C). It can be easily seen, that with an increasing twist angle 14 the bell shape of the virtual cone 15 becomes more and more pronounced.

What is claimed is:

1. A premix burner for a gas turbine, said premix burner comprising:

a plurality of shells, which are arranged around a central burner axis of the premix burner and are parts of a virtual, axially extending common cone, which opens in a downstream direction, wherein said shells are oriented perpendicular to said central burner axis such that a tangential slot is defined between each pair of adjacent shells, and wherein said virtual common cone has a cone angle which varies in axial direction;

each of the shells having an upstream end and a downstream end, the upstream end being twisted around the central burner axis by a twist angle relative to the downstream end.

2. The premix burner according to claim 1, wherein the cone angle of the virtual common cone increases in the downstream direction.

3. The premix burner according to claim 1, comprising cylindrical gas channels attached to the shells, each of the gas channels defining straight inclined paths along which premix gas is passable.

4. The premix burner according to claim 3, wherein each of the shells have holes through which premix gas from the gas channels is injectable to mix with air entering an interior defined by the shells via the tangential slots.

5. The premix burner according to claim 4, wherein the twist angle is equal to or larger than 30°.

6. The premix burner according to claim 4, wherein the twist angle is equal to or larger than 60°.

7. The premix burner according to claim 1, wherein the shells comprise four shells.

8. The premix burner according to claim 1, wherein each of the shells is equipped with a premix gas channel extending along an axially oriented edge of the respective shell such that a gas is injectable from said premix gas channel through gas injection holes into a stream of air entering an interior defined by the shells through the tangential slots.

9. The premix burner according to claim 8, wherein said premix gas channels each have a cylindrical shape.

10. A premix burner for a gas turbine, comprising:

a plurality of shells positioned around a central burner axis of the premix burner, the shells spaced apart from each other to define slots between adjacent shells, each of the slots being defined around the central burner axis;

each of the shells having a downstream end and an upstream end, the upstream end being twisted around the central burner axis relative to the downstream end about a twist angle;

each of the shells being attached to an inclined linear gas channel through which premix gas is passable.

11. The premix burner of claim 10, wherein the shells define an interior, each of the shells have holes through which the premix gas is injectable into an air stream entering into the interior via the slots.

12. The premix burner of claim 10, wherein the twist angle is equal to or larger than 30°.

13. The premix burner of claim 10, wherein the twist angle is equal to or larger than 60°.

14. The premix burner of claim 10, wherein each of the shells has a bell-type shape.

15. The premix burner of claim 10, comprising:

a fuel lance positioned adjacent to the shells.

16. The premix burner of claim 15, wherein the central burner axis passes through the fuel lance.

17. The premix burner of claim 10, wherein the shells are shaped to define a varying burner swirl number that varies along the central burner axis.

18. The premix burner of claim 10, wherein the premix burner is configured without a bluff body.

19. The premix burner of claim 10, wherein the shells define an increasing gradient of swirl strength along the central burner axis.

* * * * *